US008602411B2

(12) United States Patent
Ramseier

(10) Patent No.: US 8,602,411 B2
(45) Date of Patent: Dec. 10, 2013

(54) METHOD AND DEVICE FOR COMBINING SHEET-LIKE PRODUCTS WITH FURTHER SHEET-LIKE PRODUCTS, AND APPARATUS FOR CONVEYING SHEET-LIKE PRODUCTS, IN PARTICULAR PRINTED PRODUCTS

(75) Inventor: Marcel Ramseier, Wetzikon (CH)

(73) Assignee: Ferag AG, Hinwil (CH)

( * ) Notice: Subject to any disclaimer, the term of this patent is extended or adjusted under 35 U.S.C. 154(b) by 103 days.

(21) Appl. No.: 13/207,145

(22) Filed: Aug. 10, 2011

(65) Prior Publication Data

US 2012/0038096 A1 Feb. 16, 2012

(30) Foreign Application Priority Data

Aug. 13, 2010 (CH) ..... 1306/10

(51) Int. Cl.
*B65H 29/06* (2006.01)
*B65H 39/00* (2006.01)

(52) U.S. Cl.
USPC ..... 271/206; 270/52.16; 271/82; 271/204; 198/470.1; 198/474.1

(58) Field of Classification Search
USPC ..... 270/47, 60, 52.14, 52.16; 271/82, 204, 271/206; 198/470.1, 474.1, 803.4, 867.02
See application file for complete search history.

(56) References Cited

U.S. PATENT DOCUMENTS

| | | | | |
|---|---|---|---|---|
| 5,007,624 | A * | 4/1991 | Chandhoke | 270/58.2 |
| 5,292,111 | A | 3/1994 | Hansch | |
| 5,301,937 | A | 4/1994 | Hansch | |
| 6,237,744 | B1 * | 5/2001 | Reist | 198/465.4 |
| 6,581,752 | B2 | 6/2003 | Frei | |
| 6,976,674 | B2 * | 12/2005 | Honegger | 271/204 |
| 7,360,759 | B2 | 4/2008 | Ramseier | |
| 7,556,248 | B2 | 7/2009 | Mueller et al. | |
| 7,926,665 | B2 | 4/2011 | Schneider | |
| 2010/0012461 | A1 * | 1/2010 | Stauber et al. | 198/418.9 |
| 2010/0072028 | A1 | 3/2010 | Stauber | |
| 2011/0109031 | A1 | 5/2011 | Stauber | |

FOREIGN PATENT DOCUMENTS

| | | |
|---|---|---|
| EP | 0518063 | 12/1992 |
| EP | 0518064 | 12/1992 |
| EP | 1155992 | 11/2001 |
| EP | 1411011 | 4/2004 |
| EP | 1637491 | 3/2006 |
| EP | 2168894 | 3/2010 |
| WO | WO2007/051324 | 5/2007 |
| WO | WO2008/077260 | 7/2008 |
| WO | WO 2009/143645 | 12/2009 |

OTHER PUBLICATIONS

Search report dated Nov. 9, 2010, corresponding Swiss Application No. CH 2010 01306/10, filed Aug. 13, 2010.

* cited by examiner

*Primary Examiner* — Leslie A Nicholson, III
(74) *Attorney, Agent, or Firm* — Alston & Bird LLP

(57) ABSTRACT

The apparatus for conveying printed products has a feeding device which conveys the printed products to a discharge end. The gripper circulatory path of the gripper conveyor moves with the receiving section past the latter. During movement through the receiving section, the grippers use their gripper mouth to grasp the printed products and convey said products further. If the receiving section is located in the central position with respect to the feeding device, the printed products are grasped centrally and conveyed further. If, by contrast, the receiving section is displaced by means of the adjustment device into a side position, the printed products are grasped eccentrically and guided further.

6 Claims, 6 Drawing Sheets

METHOD AND DEVICE FOR COMBINING SHEET-LIKE PRODUCTS WITH FURTHER SHEET-LIKE PRODUCTS, AND APPARATUS FOR CONVEYING SHEET-LIKE PRODUCTS, IN PARTICULAR PRINTED PRODUCTS

CROSS REFERENCE TO RELATED APPLICATIONS

The present application claims priority to Swiss Patent Application No. CH 2010 01306/10, filed Aug. 13, 2010, which is hereby incorporated by reference in its entirety.

BACKGROUND OF THE INVENTION

1. Field of Invention

The present invention relates to a method for combining sheet-like products, in particular printed products, with further sheet-like products, to a device for combining sheet-like products, in particular folded printed products, with further sheet-like products, and to an apparatus for conveying. sheet-like products, in particular folded printed products.

2. Description of Related Art

An apparatus, a device and a method of this type are known from WO 2009/143645 A1. A self-contained gripper circulatory path of a gripper conveyor runs with a receiving section past the discharge end of a feeding device. The grippers which are driven in the circulatory direction along the gripper circulatory path are intended to use their gripper mouth at the discharge end to grasp the sheet-like products in a central section of a product border region which is adjacent to an edge which runs transversely with respect to the conveying direction and is leading in the feeding direction, and to convey said products further.

Downstream of the receiving section, as seen in the circulatory direction of the gripper conveyor, there is a supply station for insert products, past which the gripper circulatory path moves and which is intended to insert products into products moved past it by means of the gripper conveyor.

At the discharge end, the products are grasped in the central section of the product border region by means of the grippers and the insert products are inserted into said products symmetrically with respect to the gripper circulatory path, and therefore to the products, by means of the feeding device.

As known, for example, from EP 1 637 491 A1 and WO 2008/077260 A1 it may be desirable for certain purposes for the products to be transported in a manner grasped eccentrically and for insert products to be insertable into the folded sheet-like products in a manner offset laterally with respect thereto.

BRIEF SUMMARY

It is an object of the present invention to develop the method of the type in question, the device of the type in question and the apparatus of the type in question in such a manner that the products and further products can be combined differently in a simple and different manner.

This object is achieved by the methods, devices, and apparatuses described in the claims provided herein.

According to the invention, the sheet-like products are grasped by the grippers in the product border region in a manner offset in the direction of the edge with respect to a central section and are further conveyed, and the further sheet-like products are combined by means of the supply station with the sheet-like products preferably at least approximately symmetrically and especially symmetrically with respect to the grippers and in a manner offset laterally with respect to said products. For this purpose, the grippers are temporarily opened.

The apparatus according to the invention for conveying the sheet-like products, in particular folded printed products, has a feeding device. The latter is intended to transport the products in the feeding direction to a discharge end of the feeding device. Furthermore, the apparatus has a preferably clocked gripper conveyor having grippers which are guided on a preferably rail-like guide, are driven in a circulatory direction and are arranged one behind another. A self-contained gripper circulatory path of the grippers runs with a receiving section past the discharge end of the feeding device. As the receiving section passes through, the grippers can use their gripper mouth to grasp the products in a central section of a product border region which is adjacent to an edge running transversely with respect to the conveying direction and preferably to the leading edge with respect to the conveying direction, and convey the grasped products further.

In order for the options for using the apparatus to be more flexible, an adjustment device is provided according to the invention, by means of which the receiving section can be moved or can be displaced from a central position, in which the grippers grasp the products in the central section, in a direction transversely with respect to the feeding direction into a side position. During said movement or displacement from the central position into the side position, the guide is elastically deformed. In the side position of the receiving section, the products are grasped in the product border region in a manner offset in the direction of the edge with respect to the central section and conveyed further.

As an alternative, for the same purpose, the feeding device can have two consecutive conveying sections, wherein the upstream conveying section is moved or displaced by means of an adjustment device with respect to the downstream conveying section of said conveying sections, which downstream conveying section is stationary, from a central position into a side position.

In a preferred manner, the adjustment device has a rotary spindle which is mounted in a fixed position on a machine frame and on which a moving nut which is connected to the downstream conveying section sits. By rotation of the rotary spindle, the moving nut is displaced along the rotary spindle, this leading to displacement of the downstream conveying section between the central position and the side position.

If the upstream conveying section is in the central position, the grippers grasp the products in the central section; however, if said conveying section is moved or displaced into the side position, the grippers grasp the products in a manner offset laterally in the direction of the edge with respect to the central section. In this case, the receiving section can remain stationary at the same location.

In the side position, the products pass in a manner offset laterally to the downstream conveying section, this subsequently leading to the products being grasped in a manner offset laterally by the grippers.

In a preferred manner, the products are grasped at the leading edge, as seen in the feeding direction. However, it is also conceivable for said products to be grasped and transported at the trailing edge.

The apparatus according to the invention is constructed extremely simply since, in order for the products to be grasped differently by the grippers, only either the receiving section, with elastic deformation of the guide, or the upstream conveying section has to be moved or displaced by means of the adjustment device.

In a preferred manner, the receiving section or the upstream conveying section can be displaced in opposite directions with respect to the central position into the side position. The side position is preferably offset with respect to the central position by 2-5 cm, in particular by 3-3.5 cm, especially by 3.2 cm.

In a preferred manner, the grippers are moved along the gripper circulatory path thereof by means of a self-contained conveying member, in particular an articulated link chain. The grippers are preferably arranged on the conveying member at a fixed fastening spacing.

The guide preferably has a cross-sectionally C-shaped guide channel. The self-contained conveying member is guided in the guide channel. The guide channel is preferably supported in a fixed position at a distance from the receiving section. The guide channel is elastically deformed between said positionally fixed support and the receiving section when the receiving section is moved from the central position into the side position.

In a preferred embodiment, the conveying member is guided about a deflecting wheel between two consecutive sections of the guide or of the guide channel. The deflecting wheel is preferably coupled to the feeding device by means of a driving connection. If the conveying member is driven in the circulatory direction, the feeding device can be driven by the conveying member via the driving connection. In addition to a simple construction, synchronization between the feeding device and the gripper conveyor is also ensured.

The two sections are optionally located between the positionally fixed supports of the guide.

If the abovementioned driving connection is active, a torque can be exerted on the gripper conveyor, in particular on the guide thereof. The apparatus according to the invention preferably has a torque-absorbing connection between the feeding device and the guide in order to absorb said torque and to prevent the guide from moving toward or away from the feeding device or rotating.

The torque-absorbing connection preferably has a torque-absorbing bar which is fastened to a machine frame of the feeding device, runs at least approximately parallel to the axis of rotation of the deflecting wheel and interacts with a shield of the guide.

The shield is preferably connected fixedly to the sections of the guide or of the guide channel and the deflecting wheel is mounted on said shield.

The gripper circulatory path preferably has a U-shaped circulatory path section, the receiving section being located in the curved region of the circulatory path section. Those sections of the guide which form the two at least approximately parallel limbs of the circulatory path section preferably lie in a plane which runs at right angles to the direction of action of the adjustment device. In this embodiment, the elastic deformability of the guide is ensured in a simple manner and reaction forces are minimalized.

In a preferred embodiment, the feeding direction of the feeding device at the discharge end is directed at least approximately radially with respect to the curved region.

In a further preferred embodiment, the adjustment device is arranged on a machine frame of the feeding device and interacts with the guide of the gripper conveyor, in particular the shield, by means of an adjustment member. This permits a particularly simple and precise setting of the receiving section relative to the machine frame.

In a preferred manner, the adjustment device has a rotary spindle which is mounted in a fixed position on the machine frame and on which a moving nut which is connected to the guide, in particular the shield, sits. By rotation of the rotary spindle, the moving nut is displaced along the rotary spindle, this leading to displacement of the receiving region between the central position and the side position of the receiving section.

The device for combining sheet-like products with further sheet-like products, in particular printed products, preferably has an apparatus as explained above.

Furthermore, the device is provided with a supply station for the further products, which supply station is arranged downstream of the receiving section in the circulatory direction of the gripper conveyor. The gripper circulatory path leads past the supply station, and the latter is intended to combine further products with products moved past it by means of the gripper conveyor. This can take place by insertion of one further product in each case, or further products, into a folded or bound sheet-like product. It is also possible for one further product in each case, or for further products, to be brought into contact in a sheet-like manner with an outer side of the sheet-like product; in this case, the sheet-like product may also be an individual sheet. The combined products are transported further held by means of the gripper in question.

In a preferred manner, a control device is provided for opening the grippers at an opening point and for closing the grippers at a closing point, which is located downstream of the opening point in the circulatory direction, and a plurality of supporting elements are provided for the products, which supporting elements are movable along a closed supporting-element circulatory path. If further sheet-like products are to be inserted into the sheet-like products, the supporting elements are preferably movable relative to the grippers, at least in a subregion of the gripper circulatory path, in such a manner that they are capable of being entered between the two product parts of the folded sheet-like products and of supporting one of the product parts in a sheet-like manner and of holding the latter open for the insertion of the flat items.

Reference is made in this regard to WO 2009/143645 A1 which discloses in detail the construction and the manner of operation of the device in conjunction with the insertion of the further sheet-like products into the folded sheet-like products. The disclosure of said document should hereby be incorporated by reference into the present documents. In particular, it should be pointed out that the present device for inserting further sheet-like products into folded sheet-like products may contain the features of the patent claims from WO 2009/143645 A1.

The supply station preferably supplies the further sheet-like products at least approximately symmetrically, especially symmetrically, to the grippers and therefore to the gripper circulatory path of the gripper conveyor. In this case, the further sheet-like products are combined with the products at least approximately symmetrically with respect to the grippers. The combining takes place in a manner offset laterally with respect to the sheet-like products.

If the device has an apparatus as mentioned further above, and if the receiving section or the upstream conveying section is in the side position when receiving the relevant products, the further sheet-like products come to lie in a manner offset laterally with respect to the products.

The same as for the device for combining sheet-like products with further sheet-like products applies to the corresponding method.

BRIEF DESCRIPTION OF THE FIGURES

The invention is explained in more detail with reference to exemplary embodiments which are illustrated in the drawing, in which, purely schematically.

DETAILED DESCRIPTION OF VARIOUS EMBODIMENTS

Figure 1:
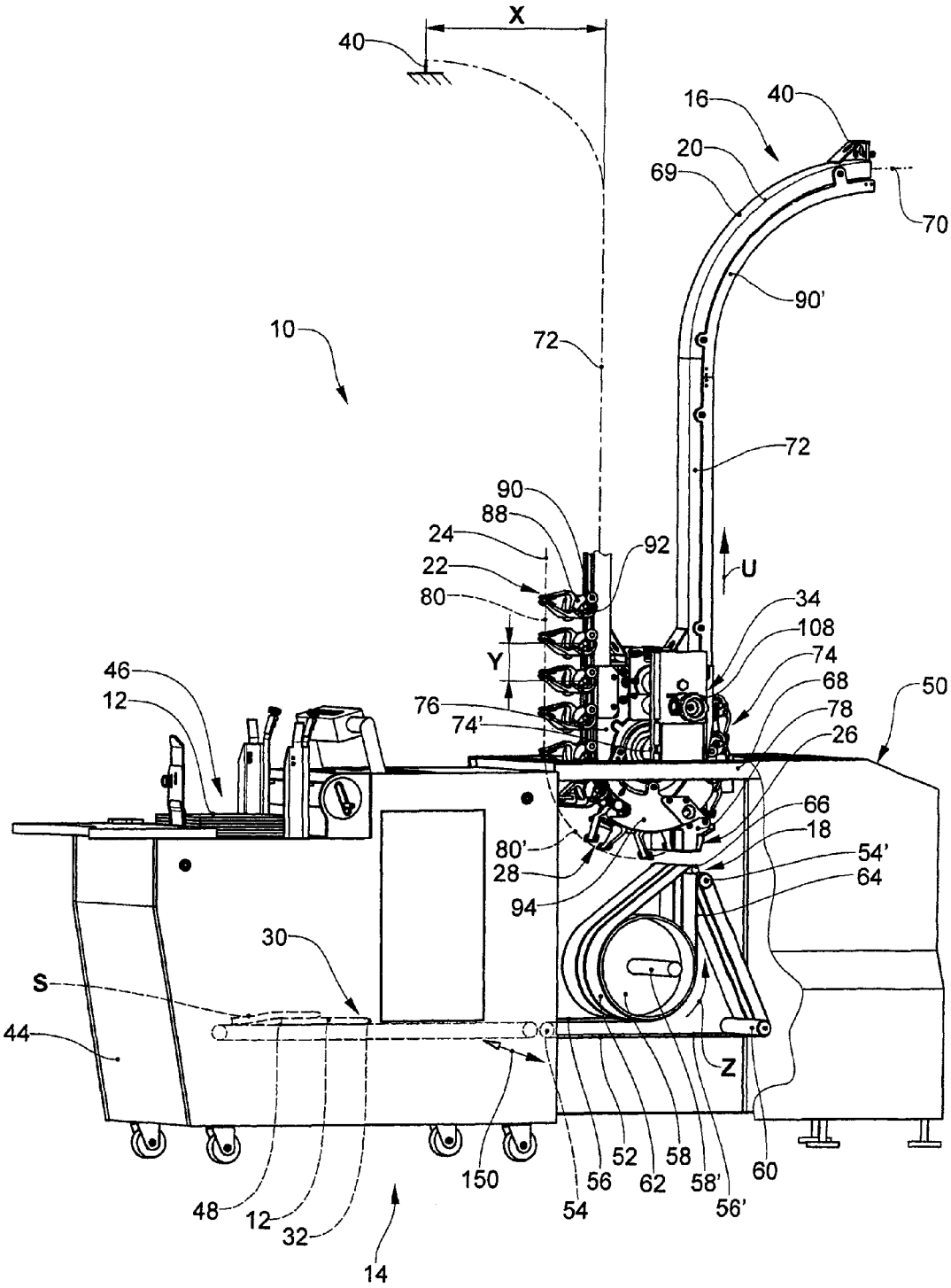
FIG. 1 shows, in a perspective view, the apparatus according to the invention with a feeding device and a gripper conveyor, with only a part relevant in conjunction with the present invention of said gripper conveyor being shown.

FIG. 1 show an apparatus 10 according to the invention for conveying sheet-like, in particular flexible products, here folded printed products 12, with a feeding device 14 and a gripper conveyor 16, of which, however, only part is shown. The feeding device 14 is intended to transport the printed products 12 in the feeding direction Z to a discharge end 18 of the feeding device.

The gripper conveyor 16 has grippers 22 which are guided on a rail-like guide 20, are driven in the circulatory direction U and are arranged one behind another. The self-contained gripper circulatory path 24 runs with the receiving section 26 thereof past the discharge end 18. The grippers 22 are intended to use their gripper mouth 28, as the receiving section 26 runs through, to in each case grasp a printed product 12, which is supplied by the feeding device 14, in a product border region 30 and to convey said printed product further in the circulatory direction U. The product border region 30 runs along an edge 32 of the printed products 12, which edge runs at right angles to the feeding direction Z, in the present case the edge which is leading, as seen in the feeding direction Z, and which also corresponds to the folded edge of the folded printed products 12; cf. FIGS. 6 and 7.

Figure 2:
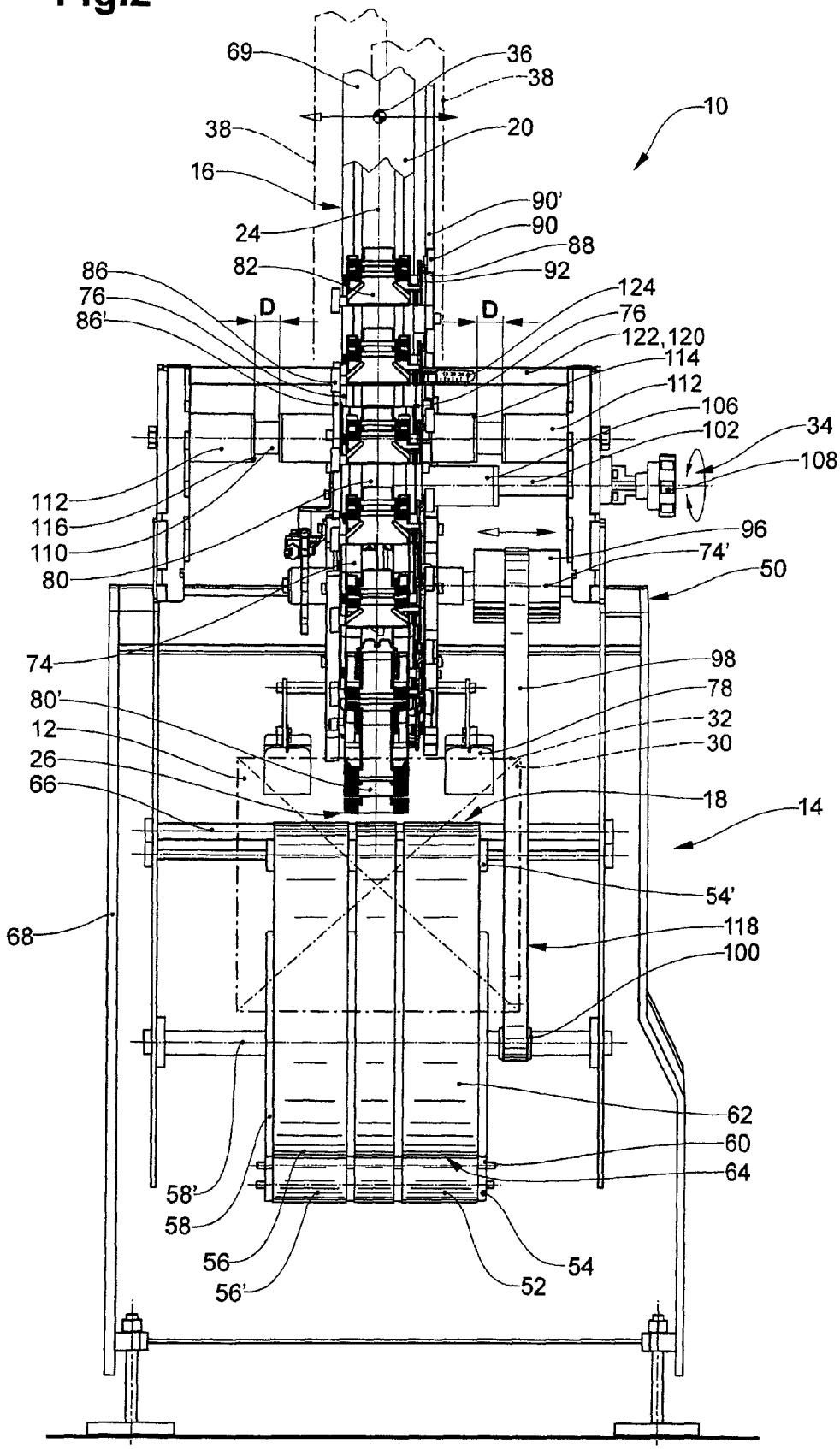
FIG. 2 shows, in a side view, part of the feeding device, and the gripper conveyor.

The receiving section 26 can be displaced by means of an adjustment device 34 in a direction at right angles to the feeding direction Z from a central position 36 into a side position 38 in the one direction and into a side position 38 in the other, opposite direction; also see FIG. 2. During the displacement of the receiving section 26 from the central position 36 into the side positions 38, the guide 20 of the gripper conveyor 16 is elastically deformed. The guide 20 is supported in a fixed position at a distance X from the receiving section by means of supports 40. The elastic deformation of the guide 20 therefore takes place between said positionally fixed supports 40 and the receiving section 26.

Figure 6:
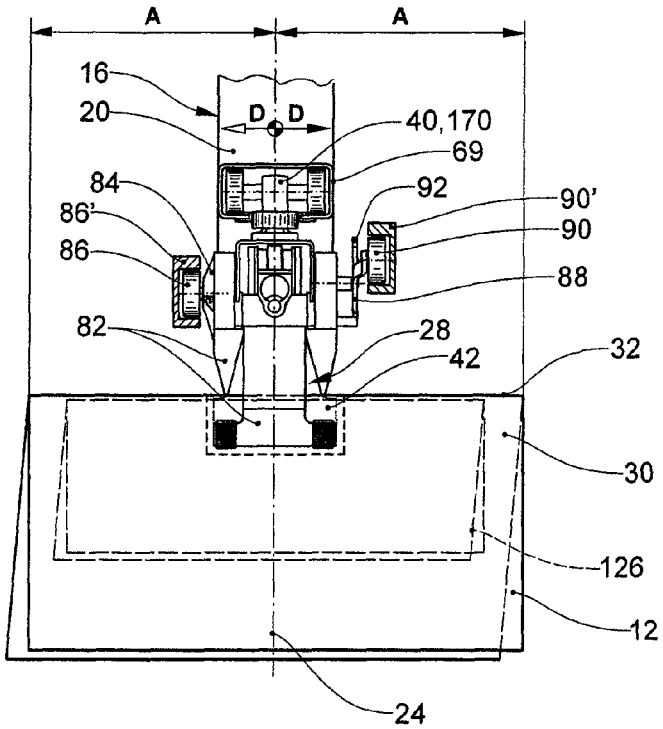
FIG. 6 shows a cross section through the gripper conveyor, the gripper shown centrally holding a folded sheet-like product and an insert product inserted into the latter.

If the receiving section 26 is in the central position 36, the printed products 12 supplied to the discharge end 18 are grasped in a central section 42 of the product border region 30 by the grippers 22 and conveyed further; compare FIG. 6. If, however, the receiving section 26 is in one of the side positions 38, the printed products 12 supplied by means of the feeding device 14—unchanged in the lateral position thereof—to the discharge end 18 are grasped in a manner offset in the direction of the edge 32 with respect to the central section 42 thereof by the grippers 22 and conveyed further; compare FIG. 7.

In the exemplary embodiment shown, the feeding device 14 has a transfer apparatus 44 for transferring the printed products from a product stack 46 onto a conveyor belt 48. Transfer apparatuses 44 of this type are generally known in the very wide variety of embodiments.

Furthermore, the feeding device 14 has a deflecting apparatus 50 which is connected downstream of the transfer apparatus 44, forms the discharge end 18 and, in the present case, also serves to separate the printed products 12 which are deposited onto the conveyor belt 48 in an imbricated formation S. Said deflecting apparatus has an endless deflecting belt 52 which, as seen in the feeding direction Z, is guided around a first deflecting roller 54 at the downstream end of the conveyor belt 48 of the transfer apparatus 44. The upper active strand 56 of the deflecting belt 52 is guided through 90° around a roll 58 downstream of the first deflecting roller 54, as seen in the feeding direction Z, such that, after the roll 58, the active strand 56 runs upward in the vertical direction to a second deflecting roller 54' which is located at the discharge end 18. The return strand 56' is guided around a tensioning roller 60 between said second deflecting roller 54' and the first deflecting roller 54.

Furthermore, a hugger belt 62 runs around the roll 58 and, together with the active strand 56, forms a conveying nip 64 for the printed products 12 and is guided around a guide roll 66 at the discharge end 18. It should be mentioned merely for the sake of completeness that, in the exemplary embodiment shown, the deflecting belt 52 and the hugger belt 62 which interacts therewith are formed by in each case three parallel belts.

The conveying nip 64 runs in the vertical direction between the roll 58 and the discharge end 18 such that, accordingly, the feeding direction Z at the discharge end 18 is directed from the bottom upward in the vertical direction.

Furthermore the deflecting apparatus 50 has a machine frame 68 on which the first deflecting roller 54, the second deflecting roller 54', the roll 58, the tensioning roller 60 and the guide roll 66 are mounted with parallel axes and so as to be freely rotatable.

In the exemplary embodiment shown, the guide 20 is formed by a cross-sectionally C-shaped guide channel 69 made of steel plate. A self-contained conveying member 70 in the form of a generally known articulated link chain is guided in said guide channel, with the grippers 22 being fastened to said articulated link chain at a fastening spacing Y. The conveying member 70 is guided around a deflecting wheel 74 between two consecutive sections 72 of the guide channel 69. The two sections 72 run parallel and in the vertical direction tangentially to the deflecting wheel 74 and in a plane which runs at right angles to the deflecting wheel axle 74'. The two sections 72 are fastened to each other in the end region thereof which faces the deflecting wheel 74 by means of two mutually opposite shields 76, with the deflecting wheel axle 74' also being mounted in a freely rotatable manner on said shields 76.

Furthermore, the adjustment device 34 acts between the machine frame 68 and said shields 76 and can be used to displace the shields 76, the deflecting wheel 74 and therefore also the receiving section 26 of the gripper circulatory path 24 at the discharge end 18 in the direction of the deflecting wheel axle 74'.

Furthermore, in the receiving section 26, a respective stationary stop 78 is fastened to the shields 76, said stop being intended to interact with the leading edges 32 of the printed products 12 in order to guide the latter in a positioned manner into the gripper mouths 28.

Mention should expressly be made at this juncture to the document EP 1 411 011 A1 which discloses in detail the construction and the manner of operation of the transfer apparatus 44 and of the gripper conveyor 16 and also the interaction thereof, in particular also with the stop 78. However, there is no adjustment device 34 there in order to displace the receiving section 26 of the gripper circulatory path 24.

The gripper circulatory path 24 has a U-shaped circulatory path section 80, wherein the two parallel limbs are defined by the sections 72 and the receiving section 26 is located in the curved region 80' of said circulatory path section 80, namely at the deflecting wheel 74. It can furthermore be seen from FIG. 1 that the feeding direction Z at the discharge end 18 runs virtually radially with respect to the curved region 80'.

The generally known grippers 22 each have two gripper limbs 82 which form the gripper mouth 28 and are rotatable about a gripper axis running at right angles to the circulatory direction U. One of the gripper limbs 82 is connected to a positioning lever 84, at the free end of which a positioning roll 86 is mounted in a freely rotatable manner, also see in this respect FIGS. 2 to 4. The other gripper limb 82 is connected in each case via a spring to a closing lever 88, at the free end of which a closing roll 90 is mounted in a freely rotatable manner. The closing lever 88 is locked releasably by means of a latching lever 92 in the closed position of the gripper 22 and tensioned spring.

A, for example, rail-like slotted positioning guide 86' and a slotted closing guide 90' respectively interact in a known manner with the positioning roll 86 and with the closing roll 90. Furthermore, in order to release the latching lever 92 from the latching position, an opening element 94 which, in the exemplary embodiment shown, is designed as a slotted opening guide is provided.

Figure 3:
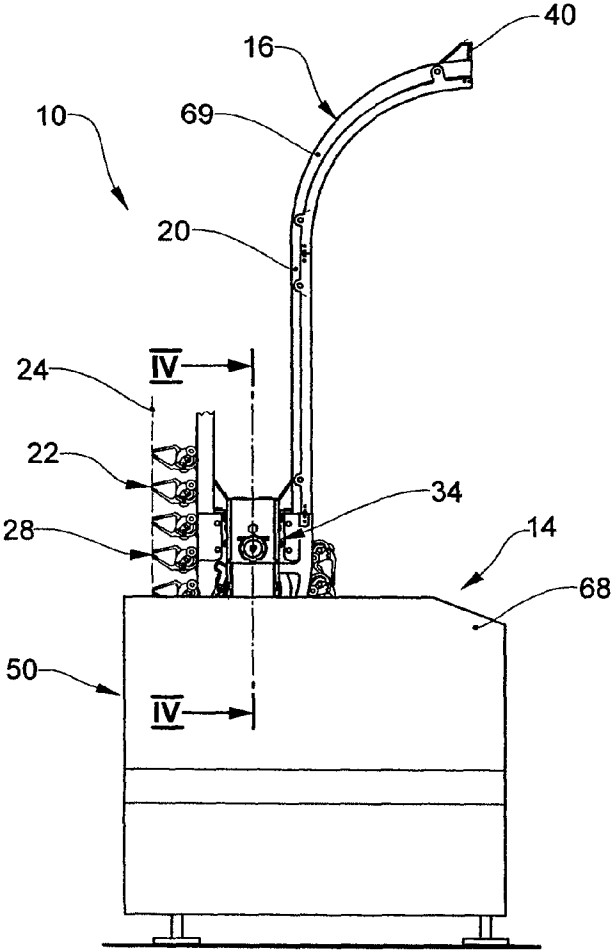
FIG. 3 shows, in a sectional view, part of the feeding device and of the gripper conveyor.

As can be gathered in particular from FIGS. 1 and 3, in the exemplary embodiment shown the closed grippers 22 are held in the section 72 leading in the circulatory direction U to the deflecting wheel 74 in a pivoted position in which the gripper mouth 28 runs approximately at right angles to the gripper circulatory path 24. The opening element 94 is located at the upstream end of the receiving section 26, and, at least in the receiving section 26, the closing roll 90 is also guided on the slotted closing guide 90' in order to open the gripper mouth 28 in the desired pivoted position during the introduction, by means of the feeding device 14, of the printed product 12 in question, with the leading edge 32 in front into the gripper mouth 28, to hold the latter in the desired rotational position and, at the end of the receiving section 26, to close the gripper mouth 28 until the latching lever 92 has latched.

Figure 4:
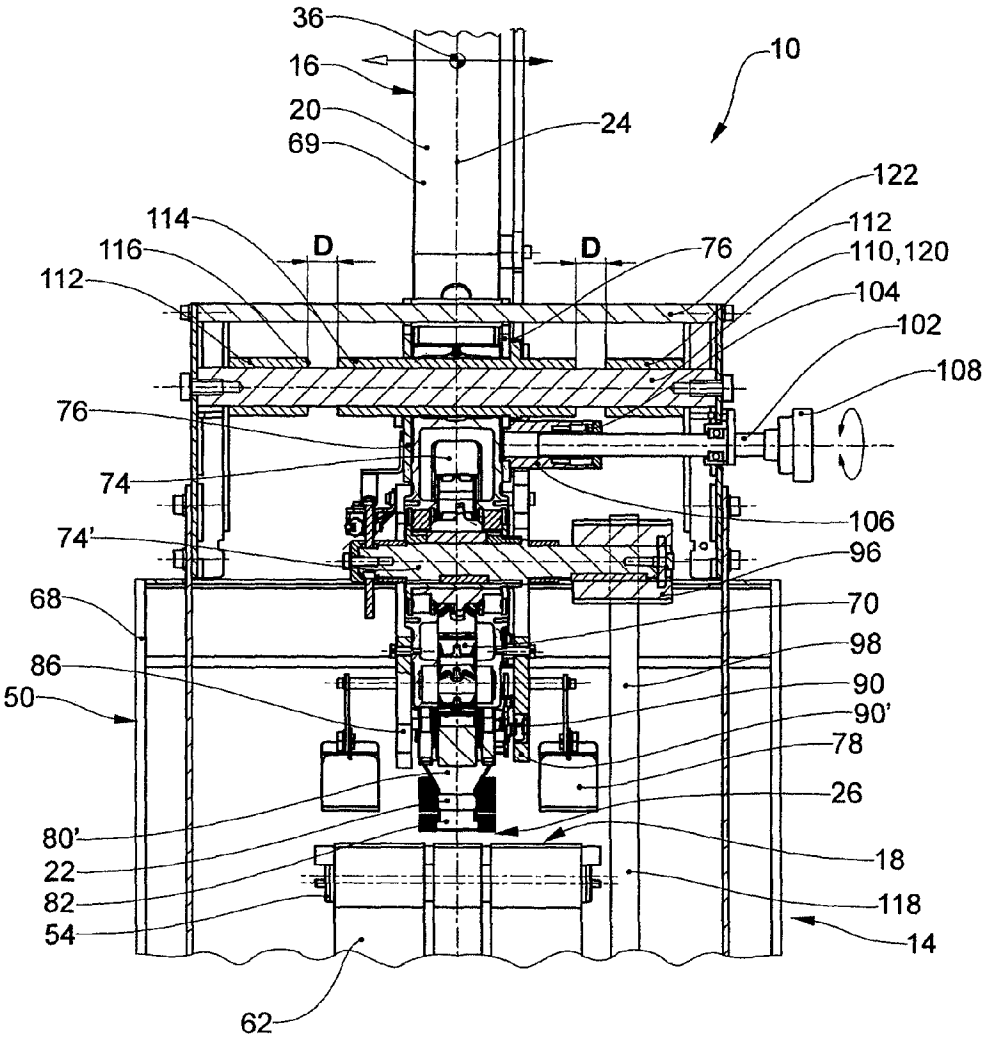
FIG. 4 shows a section along the line IV-IV in FIG. 3 through the feeding device and the gripper conveyor.

As can be gathered from FIGS. 2 and 4, the deflecting wheel 74 sits non-rotatably on the deflecting wheel axle 74' which is mounted in a freely rotatable manner on the shields 76. A first toothed wheel 96 furthermore sits non-rotatably on the deflecting wheel axle 74', said toothed wheel being connected via a toothed belt 98 to a second toothed wheel 100 which, for its part, sits non-rotatably on the roll axle 58' of the roll 58. Belt guides which are not illustrated in FIGS. 2 and 4 for the sake of better clarity prevent the toothed belt 98 from being able to migrate in the direction of the roll axle 58' and the deflecting wheel axle 74' which is parallel thereto. In contrast, it is clearly illustrated in the abovementioned figures that the first toothed wheel 96 is designed to be wider than the toothed belt 98, namely to be at least of a width such that the latter is still completely supported by the first toothed wheel 96 in the two maximum side positions 38 which are indicated in FIG. 2 by chain-dotted lines.

The adjustment device 34 has a rotary spindle 102 which is mounted in a freely rotatable manner in a fixed position on the machine frame 68. A moving nut 104 sits on the said rotary spindle, said moving nut, for its part, being held fixedly on a sleeve stump 106 which is fastened to the shield 76. A manual adjustment wheel 108 sits on the rotary spindle 102 at the free end thereof. By rotation of the manual adjustment wheel 108, the axial position of the moving nut 104 and therefore the position of the receiving section 26, is fixed.

A guide bar 110 which is fastened at both ends thereof to the machine frame 68 runs parallel to the rotary spindle 102 in the vertical direction thereabove. Stop sleeves 112 sit on said guide bar 110, and a sliding sleeve 114, which reaches through the two shields 76 and is fastened thereto, sits between the said stop sleeves. The two stop sleeves 112 bear with the outer ends thereof, as seen in the direction of the guide bar 110, against the machine frame 68 and, at their opposite, mutually facing ends, form respective stops 116 for the sliding sleeve 114 in order to fix the two maximum side positions 38.

The central position 36 in which the sliding sleeve 114 is at the same distance D of, for example, 32 mm from the two stops 116 is shown by solid lines in FIGS. 2 and 4. By rotation of the manual adjustment wheel 108 in one direction of rotation or in the opposite direction of rotation, the shields 76, and therefore the receiving section 26, are displaced in the direction of the guide bar 110, and therefore at right angles to the circulatory direction U and to the feeding direction Z, into a side position 38. The maximum side positions are determined by the stops 116. During said displacement, the toothed belt 98 correspondingly migrates on the first toothed wheel 96, and therefore the displacement always takes place as the apparatus 10 is in motion.

In the exemplary embodiment shown, the conveying member 70 is driven in the circulatory direction U. Said conveying member drives the deflecting apparatus 50 via the driving connection 118 formed by the first toothed wheel 96, the toothed belt 98 and the second toothed wheel 100.

Said driving connection generates a torque which acts on the gripper conveyor 16 and is absorbed by a torque-absorbing bar 122 which is fastened to the machine frame 68 and runs parallel to the guide bar 110. The shields 76 are mounted in a sliding manner on said torque-absorbing bar; as a result, a torque-absorbing connection 120 is formed between the feeding device 14 and the gripper conveyor 16.

It furthermore emerges from FIG. 2 that a stop 78 is arranged fixedly on each of the shields 76, symmetrically with respect to the gripper circulatory path 24. Furthermore a printed product 12 which is introduced with the leading edge 32 thereof in front into the gripper mouth 28 of a gripper 22 and interacts at the edge 32 with the stop 78 is indicated by chain-dotted lines in FIG. 2.

It should be mentioned in conjunction with FIGS. 2 and 4 that a scale 124 is fastened to the torque-absorbing bar 122. Said scale makes it possible for operating staff to read the value of the adjusted side position 38 of the receiving section 26 with respect to the central position 36.

Figure 5:
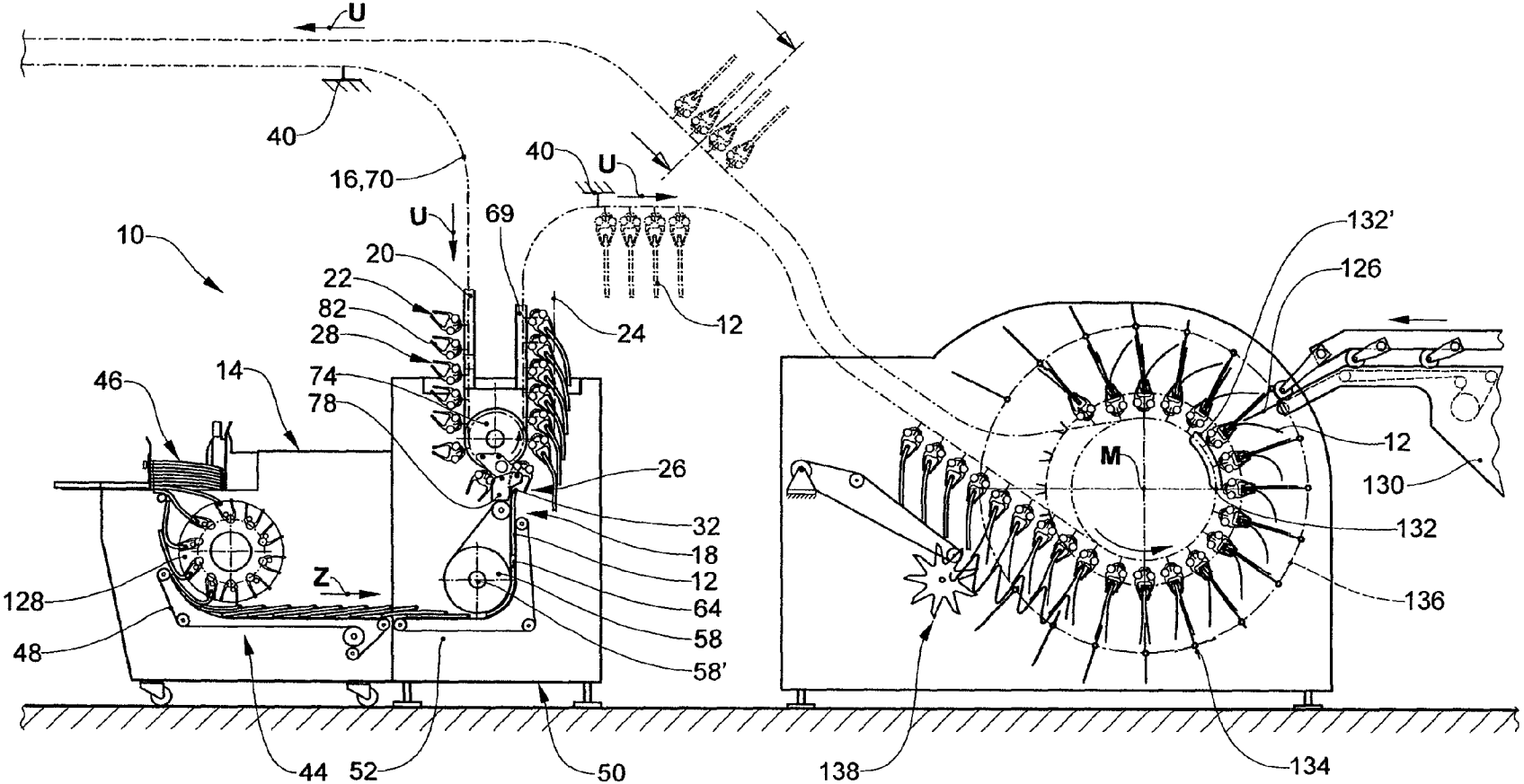
FIG. 5 shows, in a sectional view, a device according to the invention for inserting sheet-like insert products into folded sheet-like products using an apparatus as per FIGS. 1-4 and a supply station for the insert products, which supply station is connected downstream of the feeding device.

FIG. 5 shows a device for inserting sheet-like insert products 126—i.e. further sheet-like products—into folded sheet-like products, in the present case into the folded printed products 12. Said device has an apparatus 10 as shown in FIGS. 1-4 and described further above.

FIG. 5 indicates, as a supplement to FIG. 1, the suction and gripper wheel 128 of the transfer apparatus 44. Said suction and gripper wheel dismantles the product stack 46 from below in a known manner and deposits the printed products 12 drawn off therefrom onto the conveyor belt 48 in the imbricated formation S. Said conveyor belt conveys the imbricated formation S, in the feeding direction Z, to the deflecting apparatus 50, the deflecting belt 52 and hugger belt 62 of which are driven, however, at a higher speed than the conveyor belt 48. As a result, that product in the imbricated formation S which is frontmost in the feeding direction Z is in each case accelerated and brought out of the overlap with the following printed product 12 such that consecutive products 12, following one another at a distance in the conveying nip 64, can be supplied to the gripper conveyor 16. However, it should be mentioned that, as known from the document EP 1 411 011 A1, the printed products 12 can also be supplied in imbricated formation S to the transfer end 18 where the printed products 12 are then grasped individually by one gripper 22 each of the gripper conveyor 16 and conveyed away in the circulatory direction U.

A supply station 130 is arranged in the circulatory direction U downstream of the feeding device 14, and therefore the receiving section 26, past which the gripper circulatory path 24 is guided and which is intended to insert products 126 into the printed products 12 moved past it by means of the gripper conveyor 16.

In the region of the supply station 130, the gripper circulatory path 24 has a curved, in particular approximately circular profile, in which the grippers 22 are deflected through approximately 180° and, in the process, experience a change in orientation. In the region of said curved section, an opening point 132 and a closing point 132' are respectively located upstream and downstream of the supply station 130, as seen in the circulatory direction U, at which points the grippers 22 moving past said points are respectively opened and closed. This can be achieved in a known manner, for example, by means of a slotted control guide. The insert products 126 are inserted into the open printed products 12 between the opening point 132 and the closing point 132'.

In the region of the curved profile of the gripper circulatory path 24 there are a plurality of sheet-like supporting elements 134 which are moved here in a supporting-element rotational movement 136 in the same directions synchronously with the grippers 22. The supporting elements 134 are intended to enter between the two product parts of the printed products 12, which product parts are raised from each other by means of an opening apparatus 138, and to support the printed product 12 in such a manner that the insert product 126 can be inserted without the printed product 12 being displaced in an uncontrolled manner, even if the gripper 22 has been temporarily opened.

The supply station 130 is arranged in such a manner that it supplies the insert products 126 symmetrically with respect to the gripper circulatory path 24, and therefore centrally, to the gripper 122.

The insert products 126 which are inserted into the printed products 12 when the gripper mouth 28 is open come to lie in the operative region of the gripper mouth 28 such that they are securely held for further transport through the closed grippers 22, together with the printed products 12.

M refers to a driving motor which drives the gripper conveyor 16 and the supporting-element rotational movement 136. If the gripper conveyor 16 is of a very large length, it may additionally be driven by a further driving motor. However, it is also possible to drive the gripper conveyor 16 in a different manner.

Reference should be made at this juncture to the document WO 2009/143645 A1, the disclosure of which should be considered to have been incorporated by reference into the present documents. Said document shows and describes in detail the opening of the printed products 12, the insertion of the insert products 126 by means of the supply station 130 and the supporting-element rotational movement 136.

In a preferred manner, the opening device 138 can be switched on and disengaged or can be moved, in particular pivoted, into the product stream and out therefrom. It is switched on for the insertion of the insert products 126, as described above. If it is disengaged, by contrast, the printed products 12 are not opened, and therefore they come to lie in the closed state on the supporting elements 134. The further sheet-like products which are supplied by the supply station 130—said sheet-like products correspond to the insert products 126—come to lie in a sheet-like manner on the supported printed products and are then conveyed further together with said printed products, in the manner of stacks, by means of the grippers 22.

The device shown in FIG. 5 can therefore be referred to in general as a device for combining sheet-like products, here the printed products 12, with further sheet-like products 126. The combining can take place by means of insertion, depositing one onto the other, etc.

FIG. 6 shows a section through the guide 20 which is designed as a guide channel 69, and the articulated link chain 140 which is guided therein, is likewise known and forms the conveying member 70, and to each of the chain links of which a gripper 22 is fastened. For the sake of information, the slotted positioning guide 86' which interacts with the positioning roll 86 and the slotted closing guide 90' which interacts with the closing roll 90 are also illustrated.

The gripper mouth 28 holds a folded printed product 12 in the central section 42 of the product border region 30. An insert product 126 which is likewise folded is indicated by dashed lines, said insert product having been inserted into the printed product 12 by means of the supply station 130, to be precise such that it is grasped centrally, i.e. lies, like the printed product 12, symmetrically with respect to the gripper circulatory path 24.

During the supplying of the printed product 12 to the gripper conveyor 16, the receiving section 26 of said gripper conveyor was in the central position 36, as illustrated in FIG. 2 by solid lines and in FIG. 4. The symmetrical position of the printed product 12 with respect to the gripper circulatory path 24 is indicated in FIG. 6 by the two double arrows A.

Figure 7:
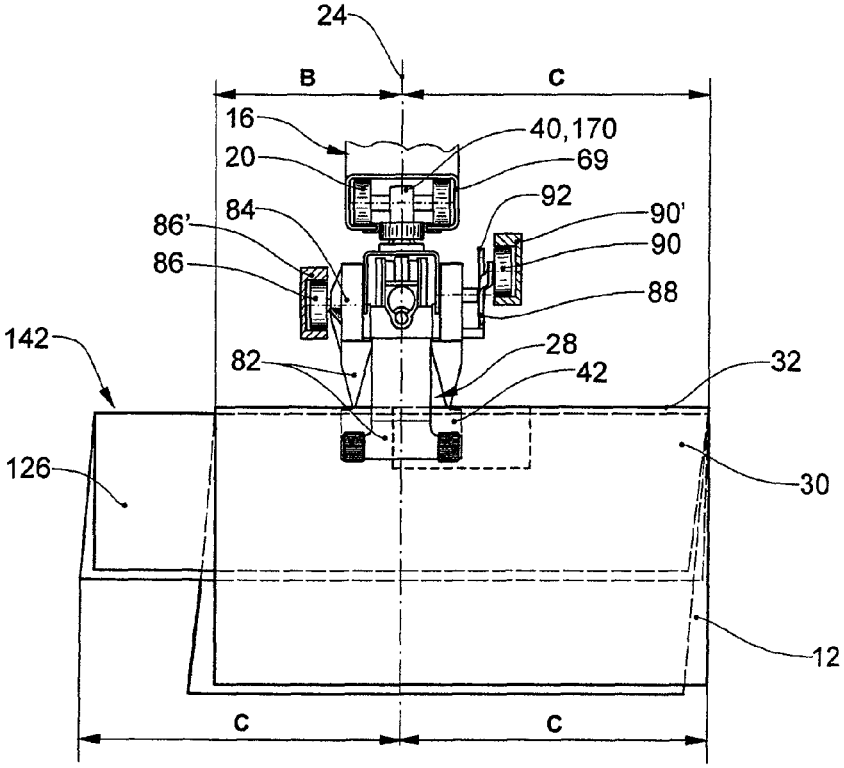
FIG. 7 shows the gripper conveyor in a similar illustration as FIG. 6, the gripper eccentrically holding the folded sheet-like product and centrally holding the sheet-like insert product inserted into the latter.

FIG. 7 shows the gripper conveyor 16 in the same illustration as FIG. 6. The gripper mouth 28 of the gripper 22 shown holds an identically designed printed product 12, as shown in FIG. 6, but now in a manner offset laterally with respect to the gripper 22 and the gripper circulatory path 24. This is indicated by the two double arrows B and C. When said printed product 12 is received in the receiving section 26, the latter was in a side position 38; in the maximum side position in the exemplary embodiment shown.

An insert product 126, which is likewise folded here, is inserted into the printed product 12, which is arranged in the gripper mouth 28 in a manner offset laterally with respect to the central section 42. Said insert product has been supplied by means of the supply station 130 symmetrically with respect to the gripper 22, and therefore symmetrically with respect to the gripper circulatory path 24. The insert product 126 is designed to be larger, as measured in the direction of the edge 32 forming the folding edge, than the printed product 12 such that it projects with a freely accessible border section 142 laterally over said printed product. In the exemplary embodiment shown, the insert product 126 is twice the length in the direction of the edge 32 as that part of the printed product 12 which is longer than the gripper circulatory path 24, as indicated by the two double arrows C. In the case shown, the finished product consisting of the printed product 12 and the insert product 126 is arranged symmetrically as a whole with respect to the gripper circulatory path 24 and the gripper 22.

Figure 8:
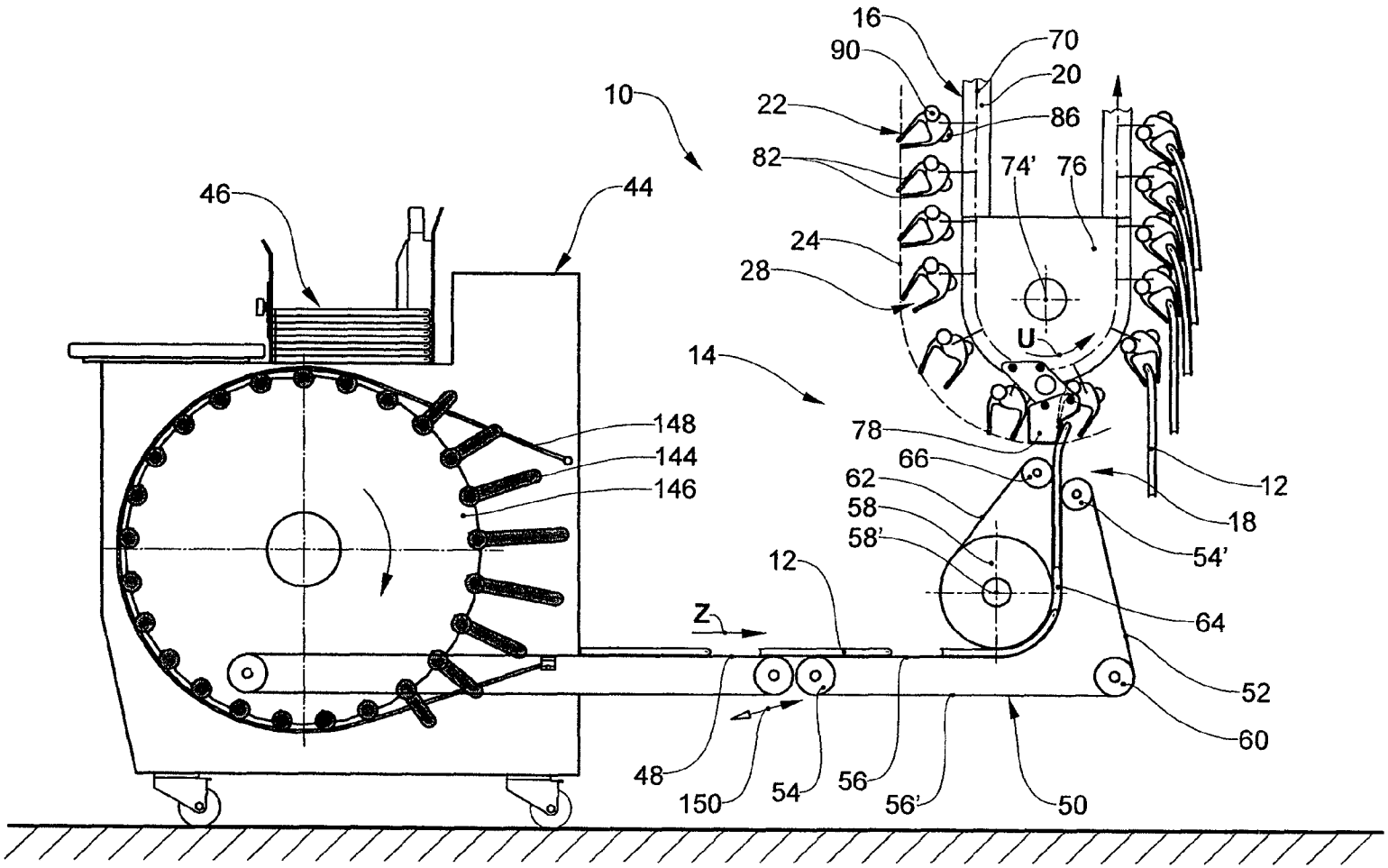
FIG. 8 shows, in a sectional view, the apparatus according to the invention for conveying sheet-like products, with a different embodiment of the feeding device.

FIG. 8 shows an embodiment of the feeding device 14 which differs with respect to FIGS. 1 and 5. Said feeding device is designed in the manner as shown in FIG. 7 of the document WO 2007/051324 A1 and described in said document.

The product stack 46 which is formed from a multiplicity of folded printed products 12 rests with an edge region on carrying rollers 144 which are mounted in a freely rotatable manner and are arranged on a circulatory member 146. Outside the abovementioned edge region, the product stack 46 preferably rests on carrying rollers which are mounted in a freely rotatable and positionally fixed manner. The carrying rollers 144 can be pivoted on the circulatory member 146 about an axis oriented tangentially with respect to the latter such that said carrying rollers can be pivoted from a carrying position, in which they run parallel to the axis of the circulatory member 146, into a position which is radial with respect to said carrying position and protrudes away from the circulatory member 146. The pivoting movement of the carrying rollers 144 is controlled by means of a slotted pivoting guide 148 designed as a belt.

A suction and gripper wheel 128 which is not shown for the sake of better clarity—see FIG. 5 and the document WO 2007/051324 A1—is located between the stacking space holding the product stack 46 and the conveyor belt 48 which is arranged below said stacking space. As disclosed in the abovementioned WO document, the suction and gripper wheel 128 in each case uses a suction head to grasp the lowermost printed product 12 of the product stack 46, and draws said printed product between two carrying rollers 144 and guides it to a gripper of the suction and gripper wheel 128. The printed product 12 which is detached in this manner from the product stack 46 is deposited onto the conveyor belt 48, which is driven in the feeding direction Z, specifically in such a manner that printed products 12 which are deposited successively come to lie at a distance one behind another on the conveyor belt 48.

In this embodiment, the deflecting belt 52 and the hugger belt 62 of the deflecting apparatus 50 connected downstream of the transfer apparatus 44 can be driven at the same speed as the conveyor belt 48.

The gripper conveyor 16 is of precisely the same design as shown in FIGS. 1-4 and described further above. The products are transferred from the feeding device 14 onto the gripper conveyor 16 in the same manner too, either in the central position 36 or a side position 38 of the receiving section 26 of the gripper circulatory path 24.

It is also possible to supply the printed products 12 to the deflecting apparatus 50 by means of a belt conveyor or clip-type transporter.

In the case of the device shown in FIG. 5, the printed products 12 are transported by means of the feeding device 14 in the feeding direction Z to the discharge end 18 of the feeding device 14. If the receiving section 26 of the gripper circulatory path 24 is in the central position 36, the printed products 12 are grasped in the central section 42 thereof of the product border region 30, which is adjacent to the leading edge 32 which runs at right angles to the feeding direction Z, by the gripper mouth 28 of one gripper 22 in each case of the gripper conveyor 16 and conveyed further. If, however, the receiving section 26 is in a side position 38, the printed products 12 are grasped in the product border region 30 thereof by the grippers 22 in a manner offset in the direction of the leading edge 32 with respect to the central section 42 and conveyed further. The receiving section 26 can be moved out of the central position 36 into the side positions 38 and back again by means of the adjustment device 34. The guide 20 of the gripper conveyor 16 is elastically deformed in the process.

The grippers 22 are guided in the guide 20, are driven in the circulatory direction U and are arranged one behind another, with the self-contained gripper circulatory path 24 thereof running with the receiving section 26 thereof past the discharge end 18 of the feeding device 14.

The printed products 12 which are received by the feeding device 14 are moved by means of the gripper conveyor 16 past the supply station 130, which is arranged downstream in the circulatory direction U, wherein the feed station 130 optionally combines a further sheet-like product 126 with each printed product 12 moved past it. For this purpose, the grippers 22 are temporarily opened during the movement past the supply station 130. The further sheet-like products 126 are introduced symmetrically with respect to the gripper circulatory path 24, and therefore with respect to the gripper 22, into the gripper mouth 28 thereof.

It is also possible, instead of the adjustment device 34 shown and described, to provide an adjustment device which acts between two consecutive conveying sections of the feeding device 14 and is indicated in FIG. 1 with the double arrow 150. The upstream conveying section can be formed, for example, by the transfer apparatus 44, and the conveying section arranged downstream with respect to said upstream conveying section can be formed by the deflecting apparatus 50 which is arranged in a stationary manner.

By means of the adjustment device 150, the upstream conveying section can be moved with respect to the stationary conveying section arranged downstream, at right angles to the feeding direction Z from a central position into side positions; for this purpose the transfer apparatus 44 can stand on wheels.

In the central position of the upstream conveying section, the printed products 12 are subsequently grasped in the central section 42 by means of the grippers 22. If, by contrast, the upstream conveying section is in a side position, the printed products 12 pass with a corresponding, lateral offset to the deflecting apparatus 50. This has the consequence that the printed products 12 are grasped by means of the grippers 22 in a manner offset with respect to the central section 42.

The invention claimed is:

1. A method for combining sheet-like products, in particular printed products, with further sheet-like products, said method comprising the following steps:

transporting the sheet-like products via a feeding device, the transporting being in a feeding direction to a discharge end of the feeding device;

grasping the sheet-like products at the discharge end in a product border region adjacent to an edge running transversely with respect to the feeding direction by a gripper of a gripper conveyor, such that the sheet-like products are grasped by the grippers of the gripper conveyor in the product border region in a manner offset in the direction of the edge with respect to a central section and the grasped sheet-like products are conveyed further via the gripper conveyor;

driving the grippers of the gripper conveyor, arranged one behind another, in a circulatory direction along a gripper circulatory path, the gripper circulatory path being self-contained and running with a receiving section past the discharge end;

conveying the sheet-like products via the gripper conveyor past a supply station for further sheet-like products arranged downstream of the receiving section in the circulatory direction of the gripper conveyor; and combining the further sheet-like product via the supply station with sheet-like products moving past the supply station via the gripper conveyor, whereby the further sheet-like products are combined via the supply station with the sheet-like products in a manner offset laterally with respect thereto.

2. The method as claimed in claim 1, wherein:

the grippers are guided in a guide; and for the grasping of the products in a manner offset in the direction of the edge with respect to the central section via the grippers, the receiving section is moved via an adjustment device from a central position, in which the sheet-like products are grasped in the central section by the grippers, with elastic deformation of the guide and in a direction transversely with respect to the feeding direction, into a side position.

3. The method as claimed in claim 1, wherein, for the grasping of the products in a manner offset in the direction of the edge with respect to the central section via the grippers, an upstream conveying section of two consecutive conveying sections of the feeding device is moved via an adjustment device with respect to the conveying section arranged downstream in a stationary manner, from a central position, in which the grippers grasp the sheet-like products in the central section, in a direction transversely with respect to the feeding direction, into a side position.

4. A device for combining sheet-like products, in particular folded printed products with further sheet-like products, said device comprising:

a feeding device configured to transport sheet-like products in a feeding direction to a discharge end of the feeding device;

a gripper conveyor having grippers that are arranged one behind another and are driven in a circulatory direction along a self-contained gripper circulatory path, the path running with a receiving section past the discharge end;

the grippers being configured for grasping the sheet-like products at the discharge end in a product border region adjacent to an edge running transversely with respect to the feeding direction, whereby the sheet-like products are grasped in the product border region in a manner offset in the direction of the edge with respect to a central section and the grasped sheet-like products are conveyed further via the gripper conveyor; and a supply station for further sheet-like products, the supply station being arranged downstream of the receiving section in the circulatory direction of the gripper conveyor and past which the gripper circulatory path is guided, wherein the supply station is configured to combine further sheet-like products moved past the supply station via the gripper conveyor and to combine the further sheet-like products with the sheet-like products in a manner offset laterally with respect thereto.

5. A device for combining sheet-like products, in particular folded printed products with further sheet-like products, said device comprising:

a feeding device configured to transport sheet-like products in a feeding direction to a discharge end of the feeding device;

a gripper conveyor having grippers that are arranged one behind another and are driven in a circulatory direction along a self-contained gripper circulatory path, the path running with a receiving section past the discharge end;

the grippers being configured for grasping the sheet-like products at the discharge end in a product border region adjacent to an edge running transversely with respect to the feeding direction, whereby the sheet-like products are grasped in the product border region in a manner offset in the direction of the edge with respect to a central section and the grasped sheet-like products are conveyed further via the gripper conveyor; and a supply station for further sheet-like products, the supply station being arranged downstream of the receiving section in the circulatory direction of the gripper conveyor and past which the gripper circulatory path is guided, wherein:

the supply station is configured to combine further sheet-like products moved past the supply station via the gripper conveyor and to combine the further sheet-like products with the sheet-like products in a manner offset laterally with respect thereto;

the gripper is further guided on a guide; and the receiving section can be moved via an adjustment device from a central position, in which the grippers grasp the sheet-like products in the central section with elastic deformation of the guide and in a direction transversely with respect to the feeding direction, into a side position in order, in the side position, to grasp the sheet-like products in the product border region in a manner offset in the direction of the edge with respect to the central section and to convey said products further.

6. A device for combining sheet-like products, in particular folded printed products with further sheet-like products, said device comprising:

a feeding device configured to transport sheet-like products in a feeding direction to a discharge end of the feeding device;

a gripper conveyor having grippers that are arranged one behind another and are driven in a circulatory direction along a self-contained gripper circulatory path, the path running with a receiving section past the discharge end;

the grippers being configured for grasping the sheet-like products at the discharge end in a product border region adjacent to an edge running transversely with respect to the feeding direction, whereby the sheet-like products are grasped in the product border region in a manner offset in the direction of the edge with respect to a central section and the grasped sheet-like products are conveyed further via the gripper conveyor; and a supply station for further sheet-like products, the supply station being arranged downstream of the receiving section in the circulatory direction of the gripper conveyor and past which the gripper circulatory path is guided, wherein:

the supply station is configured to combine further sheet-like products moved past the supply station via the gripper conveyor and to combine the further sheet-like products with the sheet-like products in a manner offset laterally with respect thereto;

an upstream conveyor section of two consecutive conveyor sections of the feeding device can be moved with respect to the conveyor section arranged downstream in a stationary manner via an adjustment device from a central position, in which the grippers grasp the sheet-like products in the central section, in a direction transversely with respect to the feeding direction, into a side position such that, in the side position, the sheet-like products are grasped in the product border region in a manner offset in the direction of the edge with respect to the central section.

* * * * *